US007794342B2

(12) United States Patent
Connerley et al.

(10) Patent No.: US 7,794,342 B2
(45) Date of Patent: Sep. 14, 2010

(54) QUICK CHANGE BACKBOARD BRACKET SYSTEM

(75) Inventors: James J Connerley, Noblesville, IN (US); Marty D. Retter, Alexandria, IN (US)

(73) Assignee: Gared Holdings, LLC, Noblesville, IN (US)

( * ) Notice: Subject to any disclaimer, the term of this patent is extended or adjusted under 35 U.S.C. 154(b) by 153 days.

(21) Appl. No.: 11/960,142

(22) Filed: Dec. 19, 2007

(65) Prior Publication Data

US 2009/0163305 A1 Jun. 25, 2009

(51) Int. Cl.
*A63B 63/08* (2006.01)

(52) U.S. Cl. ..... 473/481; 473/479

(58) Field of Classification Search ..... 473/481, 473/483, 488; 108/152; 224/509; 248/222.51; 29/426.1; 403/15, 377, 353
See application file for complete search history.

(56) References Cited

U.S. PATENT DOCUMENTS

| | | | | | |
|---|---|---|---|---|---|
| 1,522,957 | A | | 1/1925 | Kennedy | |
| 2,447,150 | A | * | 8/1948 | Andersen | 414/723 |
| 3,891,237 | A | | 6/1975 | Allen | 280/477 |
| 3,970,304 | A | * | 7/1976 | Ebstein et al. | 473/481 |
| 3,985,249 | A | * | 10/1976 | Aker et al. | 414/723 |
| 4,225,265 | A | * | 9/1980 | Hooker et al. | 403/353 |
| 4,480,578 | A | * | 11/1984 | Fisher et al. | 114/344 |
| 4,588,188 | A | * | 5/1986 | Mahoney et al. | 473/481 |
| 4,613,135 | A | | 9/1986 | Rush | 273/1.5 R |
| 4,747,612 | A | | 5/1988 | Kuhn | 280/4.6 A |
| 4,854,812 | A | * | 8/1989 | Smith et al. | 414/723 |
| 5,022,649 | A | | 6/1991 | Traub et al. | 273/1.5 R |
| 5,067,742 | A | | 11/1991 | Relja | 280/479.2 |
| 5,303,857 | A | * | 4/1994 | Hewson | 224/506 |
| 5,308,059 | A | | 5/1994 | Owen, Jr. et al. | 273/1.5 R |
| 5,480,139 | A | | 1/1996 | Owen, Jr. et al. | 273/1.5 R |
| 5,647,604 | A | | 7/1997 | Russell | 280/492 |
| 5,779,569 | A | | 7/1998 | Townsend et al. | 473/433 |
| 5,947,848 | A | * | 9/1999 | Koole | 473/483 |
| 2009/0163305 | A1 | * | 6/2009 | Connerley et al. | 473/481 |

* cited by examiner

*Primary Examiner*—Gene Kim
*Assistant Examiner*—M Chambers
(74) *Attorney, Agent, or Firm*—Brinks Hofer Gilson & Lione

(57) ABSTRACT

A quick change backboard bracket system for a basketball goal permitting the quick removal and replacement of a basketball goal can include a backboard assembly and a basketball goal support assembly. The backboard assembly can include a backboard, a first yoke member, and a rim assembly. The basketball goal support assembly can include a second yoke member, a connecting pin, and bracing means for coupling the backboard to a basketball goal support. When the basketball goal is assembled, a slot of the first yoke member is coupled to a coupling shaft of the second yoke member, the connecting pin is engaged to both yoke members, and the basketball goal support is coupled to the backboard by the bracing means. When the basketball goal is in need of replacement, all of the points of coupling, as described above, are decoupled and the old basketball goal is removed, and a new basketball goal is coupled at the points of coupling.

14 Claims, 6 Drawing Sheets

QUICK CHANGE BACKBOARD BRACKET SYSTEM

BACKGROUND

1. Technical Field

This invention relates to basketball goals generally consisting of a backboard assembly and a basketball goal support assembly. More particularly, the present invention relates to such a goal where the backboard assembly can be decoupled from the basketball goal support assembly and replaced.

2. Background Information

The game of basketball is popular throughout the world. Part of its popularity may stem from the simplicity of equipment used, i.e., at least one elevated basket and a ball. More commonly, the equipment is at least one basketball goal, which includes a backboard, a rim assembly, a basketball goal support, and a basketball. Additionally, its popularity may stem from the fact that basketball can be played outdoors and indoors, which lends itself to be played year round.

Notwithstanding, basketball goals are known to deteriorate, break, or even become dated. For example, a basketball player can exert enough force and torque on a basketball goal to distort permanently the rim assembly, shatter the backboard, or even break the basketball goal support mechanism. When this occurs, especially to the backboard and/or the rim assembly, the game, practice, or recreation of basketball must be stopped to permit facilities personnel to replace the old basketball goal with a new basketball goal. Generally, regardless of what is in need of repair, the broken basketball goal is moved away on its wheels and replaced with a new basketball goal that is moved in and fixed to the floor. Yet, the cost and expense of having one or more replacement basketball goals in storage can be great in terms of equipment and inventory space.

Alternatively, if only the backboard and/or rim assembly is in need of repair, it would be advantageous to only replace what is needed without moving the entire basketball goal and to do so quickly. Depending on the number of fasteners and couplings that engage the basketball goal to the basketball goal support, the time to replace the basketball goal can last for about twenty minutes to about one hour or more. During this hiatus, players can cool off, spectators can lose interest, and the total time for the game can be extended for a period of time.

Various basketball goals have been conceived to allow for a quicker replacement. Many involve only the rim assembly, and many of these involve only rim assemblies for the outdoors. Here, the rim assemblies generally include a rim and a mounting plate. The mounting plate would then attach via a fastener or shaft to a receiving plate that is attached to the backboard. Typically, the rim assemblies for the outdoors are more inexpensive and lesser in quality than the rim assemblies for the indoors. The rim assemblies for the indoors, including gymnasiums and arenas, are generally "commercial grade" because of the construction and materials used to account for the amount of use and mobility of basketball goals. Because of this higher quality, indoor basketball goals are more typically replaced with a new basketball goal, instead of replacing the part on the spot.

Accordingly, there remains a need for a basketball goal to be quickly replaced. In particular, there remains a need to replace the backboard and rim assembly on the spot during a timeout (a few minutes) or during a halftime (about twenty minutes). Furthermore, there remains a need to replace the backboard and rim assembly on the spot without having to replace the entire basketball goal.

BRIEF SUMMARY

The shortcomings of the prior art are addressed generally by a basketball goal that can include one or more couplings that permit the quick change and replacement with another basketball goal, yet also permit during normal use and impact, the rim to be maintained at its conventional position and effective rigidity. Particularly, the basketball goal may include a quick change backboard bracket system. The quick change backboard bracket system can comprise a backboard, a first yoke member, a rim assembly, a second yoke member, bracing means for coupling the backboard to a basketball goal support, or any combination. The backboard can have a peripheral frame with a bracket. The first yoke member can comprise a central plate coupled to the backboard and a left web and a right web fixed to the central plate. The left and right webs can extend rearwardly and each web may have a slot, an opening, or both. The rim assembly can be coupled to the central plate of the first yoke member through the backboard. The second yoke member can comprise a middle plate coupled to a basketball goal support, a left arm and a right arm fixed to the middle plate, a coupling shaft, and a connecting pin. The left and right arms can extend frontwardly and each arm may have a first aperture and a second aperture. The coupling shaft can be dimensioned to fit within, and positioned through, each first aperture. Additionally, the coupling shaft can be dimensioned to engage the slot of the first yoke member. The connecting pin can be dimensioned to engage each opening of the first yoke member and each second aperture of the second yoke member.

Another embodiment of the quick change backboard bracket system can comprise a backboard assembly and a basketball goal support assembly as components of a kit. The backboard assembly can include a backboard, a first yoke member, and a rim assembly similar to that described above. The basketball goal support assembly can include a basketball goal support comprising a second yoke member, a coupling shaft, a connecting pin, and a bracing member to couple the corner brackets of the backboard similar to that described above.

Yet, another embodiment provides a method of replacing the backboard assembly using the quick change backboard bracket system. The method can comprise the steps of providing a first backboard assembly and a second backboard assembly like the first backboard assembly. The connecting pin can be disengaged from each opening of the first backboard assembly and each second aperture of the basketball goal support assembly. The bracing member of the basketball goal support assembly can be decoupled from each bracket of the first backboard. The slot of the first backboard assembly also can be disengaged from the coupling shaft of the basketball goal support assembly. The connecting pin can be engaged to each opening of the second backboard assembly, which has replaced the position of the first backboard assembly, and each second aperture. The bracing member can be coupled to each bracket of the second backboard assembly. The slot of the second backboard assembly also can be engaged to the coupling shaft.

For the purposes of promoting an understanding of the principles of the invention, reference will now be made to the embodiments illustrated in the drawings, and specific language will be used to describe the same. It should nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

DETAILED DESCRIPTION OF THE DRAWINGS AND THE PRESENTLY PREFERRED EMBODIMENTS

Figure 1:
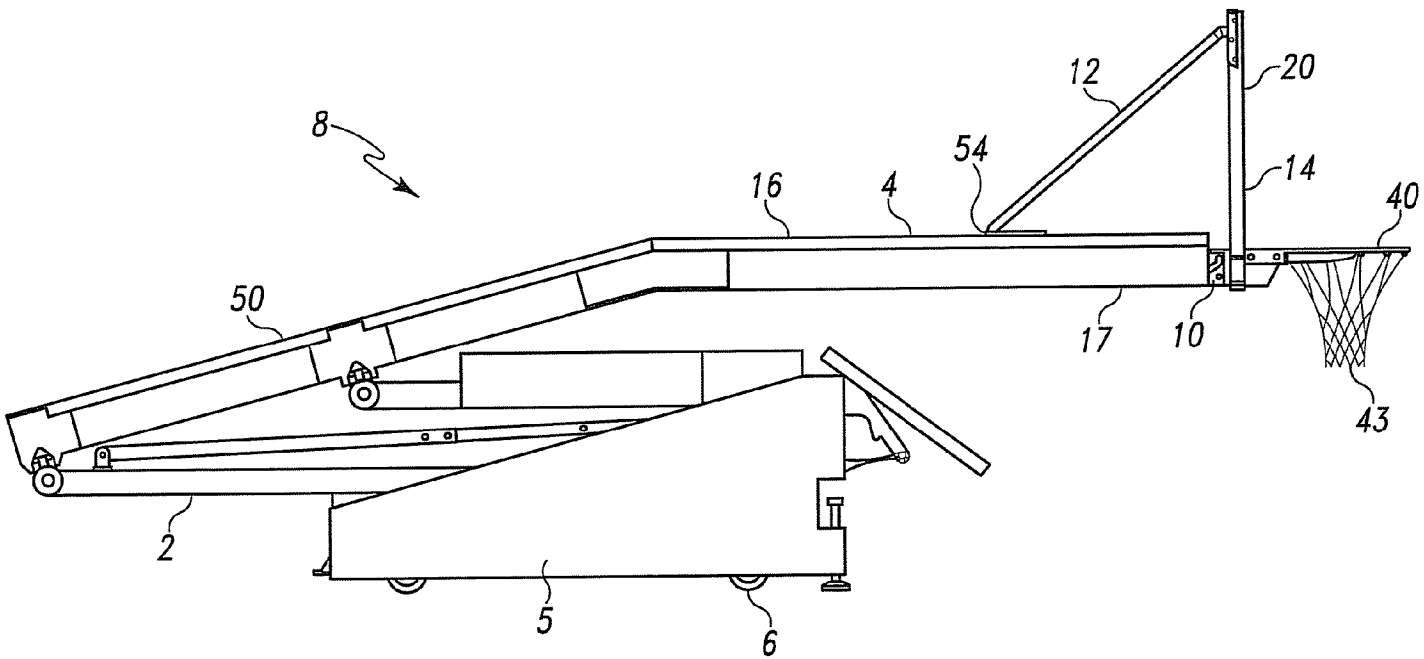
FIG. 1 is a side view of a basketball goal.
Figure 2:
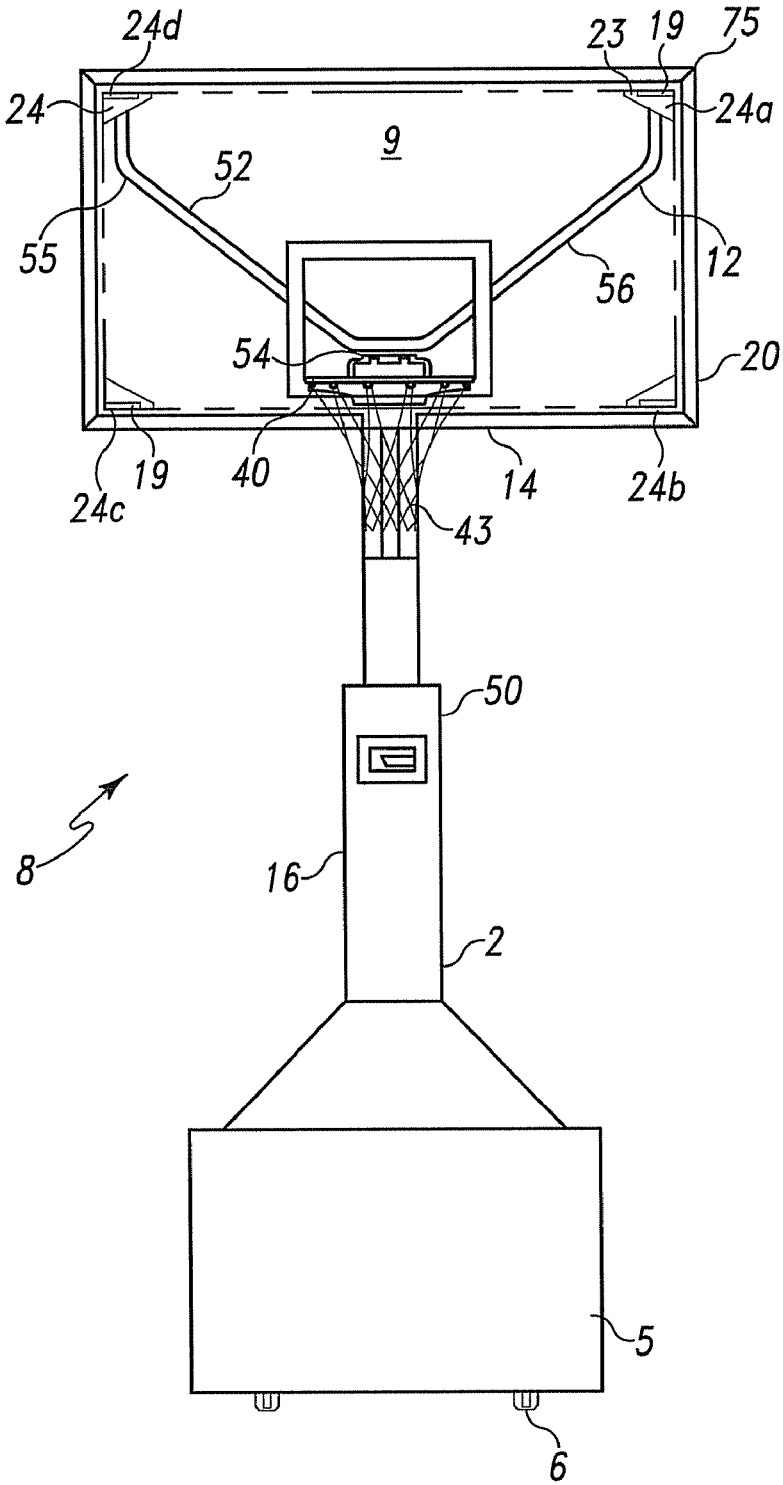
FIG. 2 is a front view of the basketball goal.
Figure 3A:
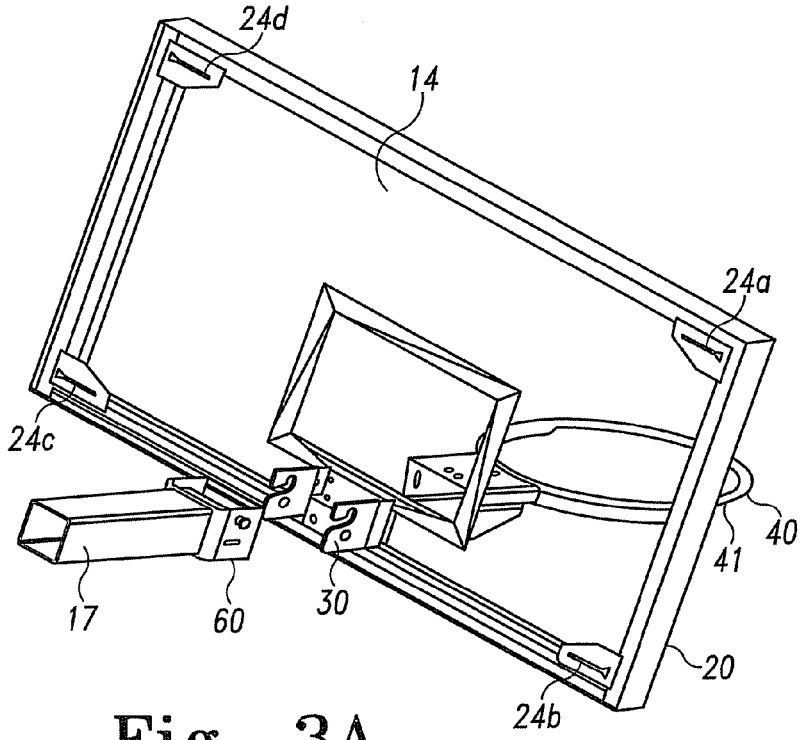
FIG. 3*a* is a rear perspective view of a backboard assembly including a rim assembly and a first and second yoke member of one embodiment of the invention.

FIGS. 1 and 2 shows a side view and a front view a basketball goal system 8 including an illustrative quick change backboard bracket system 10 having a backboard assembly 14 coupled to a basketball goal support assembly 16. The backboard assembly 14 can include a backboard 20, a rim assembly 40, and a first yoke member 30, as shown in FIG. 3*a*. The basketball goal support assembly 16 can include a second yoke member 60, bracing means 12 coupled on the upper portion 9 of the backboard 20 to support the basketball goal support assembly 16, and a basketball goal support 50. The basketball goal system 8 can be stationary or can be a mobile system. An illustrative basketball goal system 8 is a GARED Pro 5017 Portable Basketball Goal System shown in FIGS. 1 and 2. The GARED Pro 5017 Portable Basketball Goal System includes a hydraulic portable backstop 2 for lowering and raising the system, a decreasing trapezoidal extension arm 4 for stability to the backboard 20 and rim assembly 40, regulation glass competition backboard 20, rim assembly 40 having a breakaway goal, base 5, and wheels 6 for rolling and maneuvering the system.

The quick change backboard bracket system 10 can allow for a quick and easy removal and replacement of the backboard assembly 14. The various components of the quick change backboard bracket system 10 are dimensioned to have tolerances to ensure that the basketball goal system as assembled has the desired stability in the case of a dunk shot or a player hanging on the rim. Furthermore, it is desired that no special tools be required for replacing the backboard assembly 14.

The backboard 20 of the backboard assembly 14 has a peripheral frame 22 as shown in FIG. 2. Preferably, the backboard 20 is rectangular; however, the backboard 20 can be any shape known by one of ordinary skill in the art. The backboard 20 can be made of glass or other transparent materials or composites, while the peripheral frame 22 can be made in any metal known in the art, such as steel. The backboard 20 can also have apertures, not shown, that allow fasteners 46 to run through it.

The backboard 20 can further include at least one bracket 23 that can couple to a bracing member 52. One embodiment of the backboard 20 and the bracket 23 is shown in FIG. 2. Here, the brackets 23 are corner brackets 24; that is, four corner brackets with one corner bracket 24*a* being in the upper-right portion of the backboard 20, one corner bracket 24*b* being in the lower-right portion of the backboard 20, one corner bracket 24*c* being in the lower-left portion of the backboard 20, and one corner bracket 24*d* being in the upper-left portion of the backboard 20. The corner brackets 24 may be a corner gusset which may have a slot or opening 19 for engaging the bracing member 52.

The bracing means 12 may have a single bracing member 52. Other embodiments of the bracing means 12 may have two or more bracing members 52. The bracing member 52 can have a basketball goal support coupling 54 on a connecting arm portion 17 of the basketball goal support assembly. The basketball goal support coupling 54 may be used to couple the backboard 20 to the basketball goal support 50. In addition, the bracing means 12 can comprise at least one or more supporting members 55, preferably two supporting members 55, 56. One embodiment of the bracing means 12 is two supporting members 55, 56, shown in FIG. 2. Here, the two supporting members 55, 56 extend vertically and frontwardly toward the backboard 20 to couple to the two corner brackets 24*a*, 24*d* of the upper portion 9 of the backboard 20 with a pin and hairpin clip retainer 75.

Figure 3B:
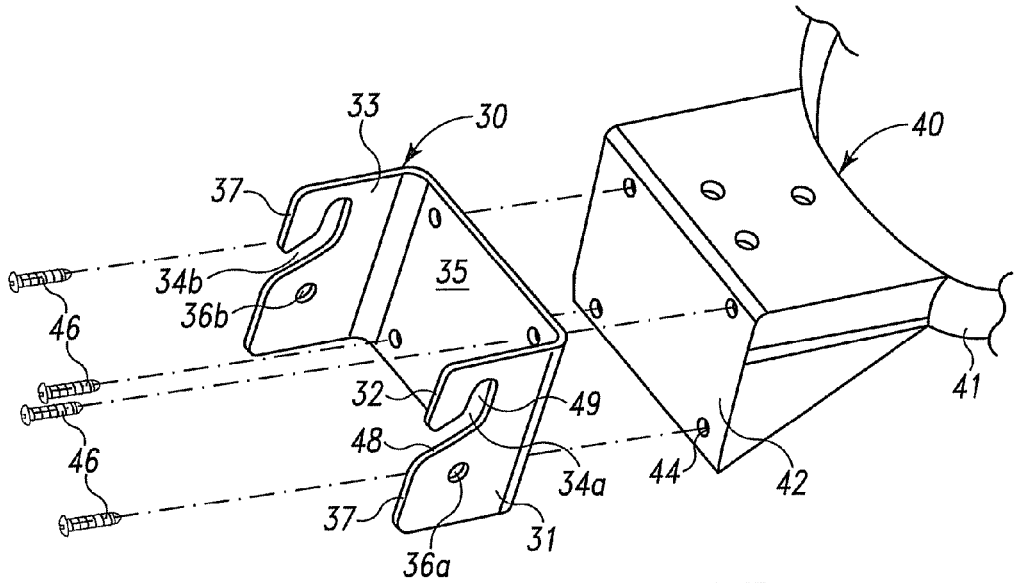
FIG. 3*b* is a rear perspective view of a rim assembly and a first yoke member of one embodiment of the invention.
Figure 3C:
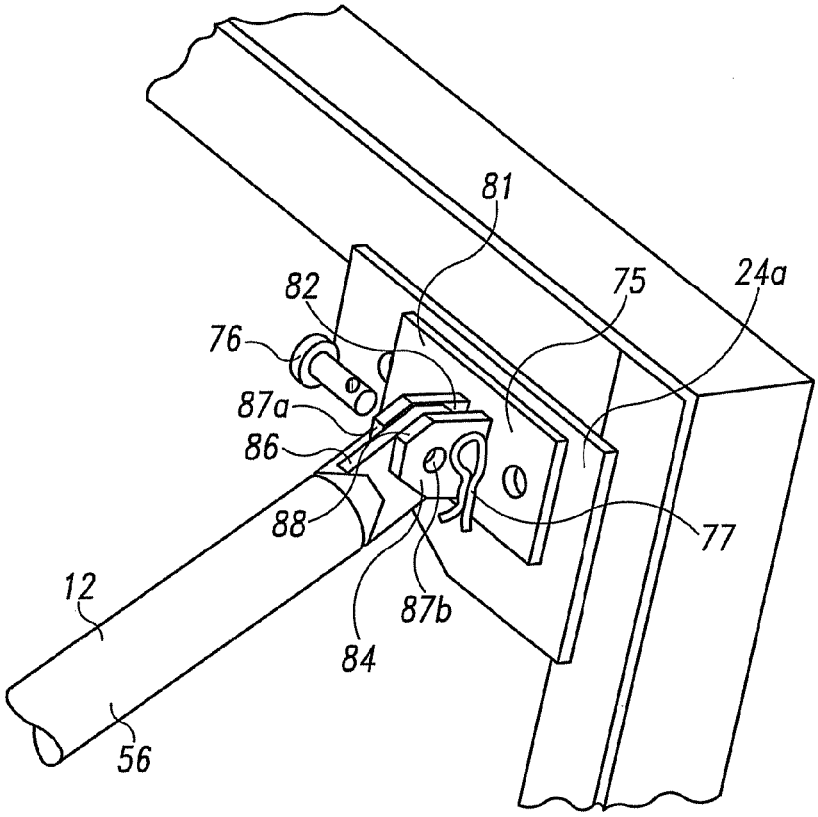
FIG. 3*c* is a rear perspective detail view of one corner of the backboard showing a coupling between a corner bracket and a bracing member.

In FIG. 3*c*, the pin and hairpin clip retainer 75 preferably includes a supporting plate 81 fixed to each corner bracket 24. The supporting plate 81 has two vertically-oriented members 82, 84 extending away from the backboard 20. The vertically-oriented members 82, 84 are preferably separated by distance that is substantially the same or slightly greater than the lateral distance of an adjoining member 86 from the supporting members 55, 56 of the bracing means 12. The two vertically-oriented members 82, 84 also have an opening 87*a*, 87*b* that are axially align with a similar opening 88 in the adjoining member 86. It is through these openings 87*a*, 87*b*, 88, when the adjoining member 86 is positioned between the supporting members, that a pin 76 is inserting therethrough. After the pin 76 is inserted, the hairpin clip 77 is affixed to the pin 76 to secure that portion of the backboard 20.

Figure 4:
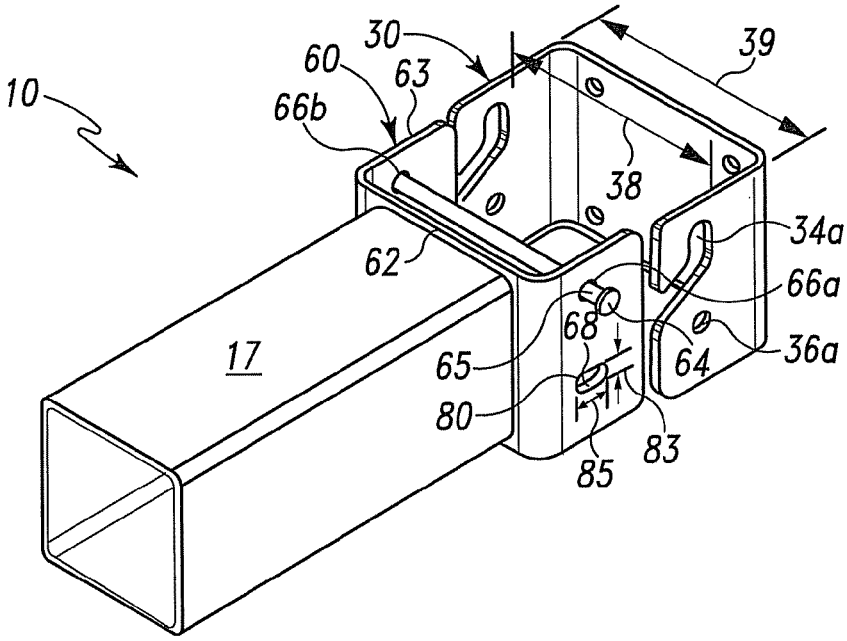
FIG. 4 is a rear perspective view of the first yoke member decoupled from a second yoke member of another embodiment of the invention.
Figure 5:
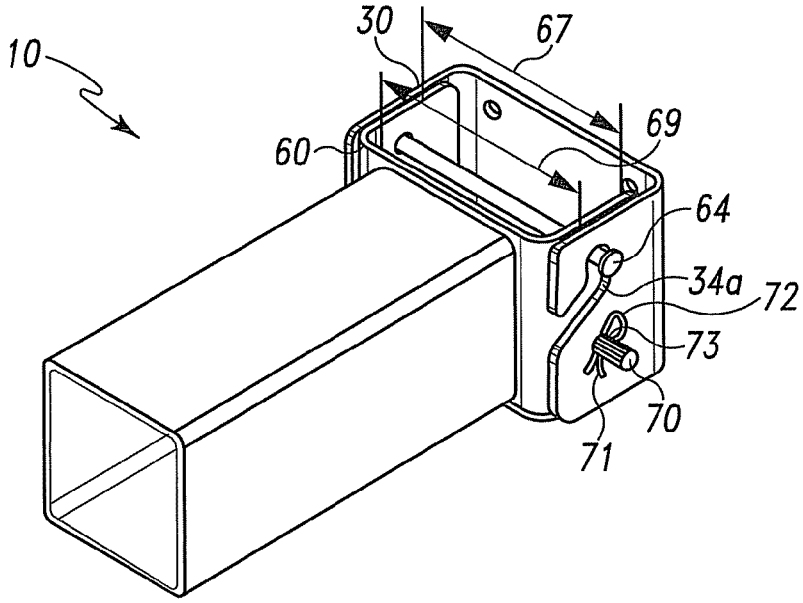
FIG. 5 is a rear perspective view of the first yoke member coupled to a second yoke member of the embodiment in FIG. 4.

Referring to FIGS. 3-5, the first yoke member 30 can include a central plate 32. One embodiment of the first yoke member 30 is shown in FIG. 3*a* and in more detail in FIG. 3*b*. Here, the central plate 32 can have apertures 28. The apertures 28 can be for receiving fasteners 46, which pass through the mounting plate 42, backboard 20, and central plate 32. The first yoke member 30 can also include a left web 31 and a right web 33 fixed to the central plate 32. The left and right webs 31, 33 can extend rearwardly away from the backboard 20 in the vertical position, perpendicular to the backboard 20.

Each web 31, 33 can have a slot 34*a*, 34*b*, at least one opening 36*a*, 36*b*, or both. Each slot 34*a*, 34*b* can have one direction or can be multi-directional. Preferably, each slot 34*a*, 34*b* in FIG. 3*b* is bi-directional, with one portion 48 of the slot having a direction that is frontwardly and upwardly diagonal and with another portion 49 of the slot 34*a*, 34*b* having a direction that is upward or vertical and parallel to the backboard 20. To the contrary, in FIG. 6*a*, the open ended slot 134' is bi-directional, with one portion 148 of the slot having a direction that is rearwardly and downwardly diagonal and with another portion 149 of the slot 134' having a direction that is downward or vertical and parallel to the backboard.

Alternatively, each slot 34*a*, 34*b* can have only one direction that is upward, only one direction that is frontward or horizontal, or any other direction. Additionally, each slot 34*a*, 34*b* can be created from the top side, from the bottom side, from the front side, or from the rear side of each web 31, 33. Preferably, each slot 34*a*, 34*b* is created at the upper portion 35 and from the rear side 37 of each web 31, 33 as shown in FIG. 3*b*. Alternatively, in FIG. 6*a* each slot 134' is created at the lower portion 135 and from the front side 137 of each web 131*a*, 131*b*, 133*a*, or 133*b*. Each slot 34*a*, 34*b* can be dimensioned to receive a coupling shaft 64, as shown in FIG. 4. Furthermore, each slot 34*a*, 34*b* can be axially aligned or can be positioned on each web 31, 33 so that each slot 34*a*, 34*b* is in mirror symmetry. Similarly, each opening 36*a*, 36*b* can be dimensioned to receive a connecting pin 70, shown in FIG. 5. Each opening 36*a*, 36*b* can be axially aligned, can be positioned on each web 31, 33 so that each slot 34*a*, 34*b* is in mirror symmetry, or both.

Referring to FIG. 3*b*, the rim assembly 40 can include a mounting plate 42. The mounting plate 42 can have apertures 44 for receiving a fastener 46. For example, four apertures 44 with four fasteners 46 are shown in FIG. 3*b*. It is desired that the apertures 44 of the mounting plate 42, the apertures (not shown) of the backboard 20, and the apertures 28 of the central plate 32 have a common longitudinal axis and be aligned. Fasteners 46 can be used to run through all these apertures to secure the mounting plate 42 to the back surface of the backboard 20, the backboard 20, and central plate 32 to the front surface of the backboard 20. Any suitable fastener known in the art can be used, such as screws, bolts, or rivets. Preferably, the number of fasteners 46 should be the same as the number of apertures. The rim 41 is mounted so that it is in the conventional horizontal position. A net 43, as shown in FIGS. 1 and 2, can be suspended from the rim 41 in the usual manner.

The quick change backboard bracket system 10 may also include the second yoke member 60, with one embodiment shown in FIG. 4. The second yoke member 60 can include a middle plate 62. The middle plate 62 of the second yoke member 60 may be coupled to and may extend from the basketball goal support 50 as shown in FIGS. 1 and 2. The second yoke member 60 and the basketball goal support 50 may be one unit. Alternatively, the second yoke member 60 may be a single unit that can be attached to any basketball goal support.

The second yoke member 60 can also include a left arm 61 and a right arm 63, which can be fixed to the middle plate 62. The left and right arms 61, 63 can extend frontwardly toward the backboard 20 in the vertical position, perpendicular to the backboard 20. Each arm 61, 63 can have a first 66*a*, 66*b* and a second aperture 68. Each first aperture 66*a*, 66*b* can be dimensioned to receive a coupling shaft 64 as shown in FIG. 4. The coupling shaft 64 can be dimensioned to fit within and positioned through each first aperture 66*a*, 66*b* of the second yoke member 60 and to engage each slot 34*a*, 34*b* of the first yoke member 30. Means for attaching the coupling shaft 64 to each first aperture 66*a*, 66*b* can comprise of welding. Moreover, other means for attaching can include press fitting the coupling shaft 64 within each first aperture 66*a*, 66*b*, mechanically expanding the coupling shaft 64 with each first aperture 66*a*, 66*b*, or any other means known in the art by one of ordinary skill.

Moreover, each second aperture 68 can be dimensioned to receive the connecting pin 70 as shown in FIG. 5. Though each second aperture 68 can have a circular edge; preferably, each second aperture 68 has an elliptical edge 80 that has a first cross sectional distance 85 in the horizontal direction greater than a second cross sectional distance 83 in the vertical direction as shown in FIG. 4. Alternatively, the elliptical edge 80 can have the first cross sectional distance 85 be less than the second cross sectional distance 83. If each second aperture 68 has a circular edge, it should be slightly larger than the dimension of the opening 36*a*, 36*b* of the first yoke member 30. The slightly larger dimensioned second aperture or the elliptical edged second aperture would allow for some small margin in error in manufacturing and assembling when coupling the first yoke member 30 to the second yoke member 60. Furthermore, by having one direction of each slot 34*a*, 34*b* be perpendicular to the predominant direction 83 or 85 of the elliptical edge 80 of each second aperture 68 can allow for easier assembly.

The connecting pin 70 is dimensioned to engage each opening 36*a*, 36*b* of the first yoke member 30. Means 71 for engaging the connecting pin 70 to and from each opening 36*a*, 36*b* and each second aperture 68 can include a retainer pin 72, as shown in FIG. 5. Other means 71 for engaging the connecting pin 70 can be a bolt/nut fastener, a bolt and retainer pin fastener, or any other means known by one of ordinary skill in the art. It is desired that whatever means 71 for engaging the connecting pin 70 can also be quickly disengaged. One example is the retainer pin 72, which can be inserted through an opening 73 of the connecting pin 70, around the circumference of the connecting pin 70, or both.

The first yoke member 30 and the second yoke member 60 can be constructed of a metal channel, e.g., a steel channel or iron channel. Alternatively, the first yoke member 30 and the second yoke member 60 can be constructed from multi-metal pieces welded or secured together by any means known by those skilled in the art.

Referring to FIGS. 4 and 5, the arms 61, 63 of the second yoke member 60 can be separated by an outermost lateral distance 69 that is less than an innermost lateral distance 38 of the webs 31, 33 of the first yoke member 30. The coupling shaft 64 may have projecting ends 65 to engage each slot 34*a*, 34*b* of the first yoke member 30. The coupling shaft 64 may also have a lateral dimension greater than an outermost lateral distance 39 of the webs 31, 33 of the first yoke member 30. In another embodiment, the webs 31, 33 of the first yoke member 30 can be separated by an outermost lateral distance 39 that is less than an innermost lateral distance 67 of the arms 61, 63 of the second yoke member 60.

Figure 6A:
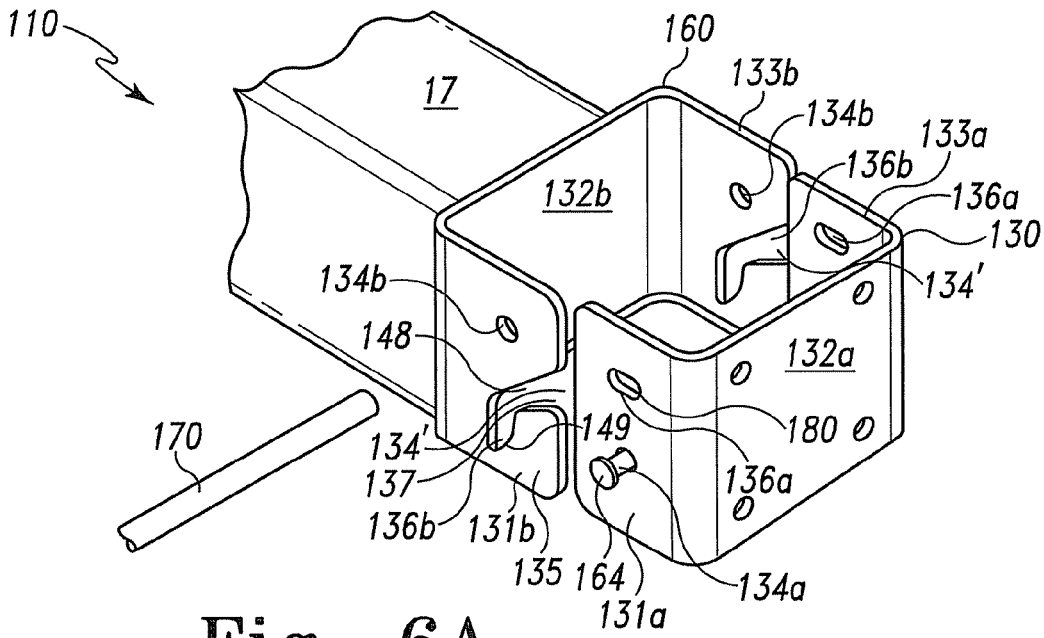
FIG. 6*a* is a front perspective view of a first yoke member decoupled from a second yoke member of an alternative embodiment of the invention.
Figure 6B:
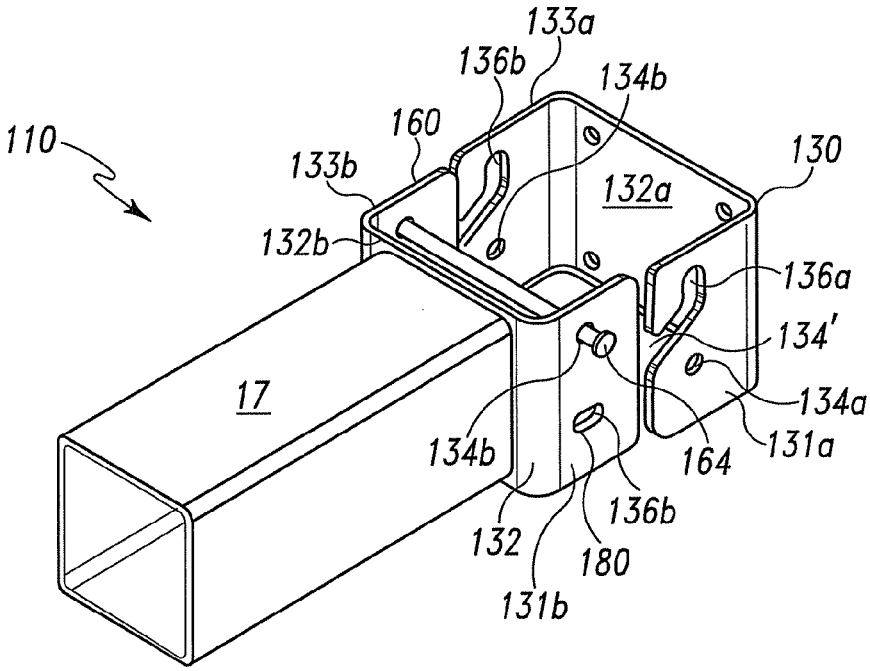
FIG. 6*b* is a front perspective view of a first yoke member decoupled from a second yoke member of an alternative embodiment of the invention.

In an another embodiment shown in FIGS. 6*a* and 6*b*, the quick change backboard bracket system 110 can include an alternative first yoke member 130 and second yoke member 160. The quick change backboard bracket system 110 can include all of the limitations described above. For example, each yoke member 130, 160 can include a central plate 132*a*, 132*b*. Each yoke member 130, 160 can also include a left web 131*a*, 131*b* and a right web 133*a*, 133*b* fixed to the central plate 132*a*, 132*b*. The left webs 131*a*, 131*b* and right webs 133*a*, 133*b* may extend away from the central plate 132*a*, 132*b*. Furthermore, the left 131*a*, 131*b* and right webs 133*a*, 133*b* can have a first opening 134*a*, 134*b*, a second opening 136*a*, 136*b*, or both. Here, the second openings 136*a* or 136*b* in the webs of one of the first yoke member 130 and second yoke member 160 can be a closed-ended slot 180. On the other hand, the second openings 136*a* or 136*b* in the webs of another of the first yoke member 130 and second yoke member 160 can be an open-ended slot 134'.

The central plate 132*a* of the first yoke member 130 can be coupled through a backboard to a rim assembly, similar to what is shown in FIG. 3*a*. Referring back to FIGS. 6*a* and 6*b*, the left web 131*a* and the right web 133*a* of the first yoke member 130 can be mounted in the vertical configuration and can extend away from the backboard. The central plate 132*b* of the second yoke member 160 can be coupled to a basketball goal support. Each web 131*b*, 133*b* of the second yoke member 160 can be mounted in the vertical configuration and can extend toward the backboard.

A coupling shaft 164 can be dimensioned to fit within, and positioned through, each first opening 134*a* or 134*b* of one of the first yoke member 130 and second yoke member 160. Also, the coupling shaft 164 can be dimensioned to engage either each second opening 136*a* or 136*b* of another of the first yoke member 130 and second yoke member 160, whichever is the opposite of the one yoke member having the first openings engaged to the coupling shaft 164.

A connecting pin 170 can be dimensioned to fit within and to engage to each first opening 134*a* or 134*b* of another of the first yoke member 130 and the second yoke member 160, whichever yoke member is opposite to the one that has the first openings engaged to the coupling shaft 164. The connecting pin 170 can also be dimensioned to fit within and to engage each second opening 136*a* or 136*b* of one of the first yoke member 130 and the second yoke member 160, whichever yoke member is opposite to the one that has the second openings to be engaged to the coupling shaft 164. This second opening 136*a* or 136*b* can have an elliptical edge.

To illustrate, the coupling shaft 164 can be dimensioned to fit within, and is positioned through, each first opening 134*a* of the webs 131*a*, 133*a* of the first yoke member 130 as shown in FIG. 6*a*. Additionally, the coupling shaft 164 can be dimensioned to engage each second opening 136*b* or open-ended slots 134' of the webs 131*b*, 133*b* of the second yoke member 160. Likewise the connecting pin 170 can be dimensioned to fit within and to engage each second opening 136*a* or closed-ended slots 180 of the webs 131*a*, 133*a* of the first yoke member 130 and each first opening 134*b* of the webs 131*b*, 133*b* of the second yoke member 160.

The opposite may also be employed. Referring to FIG. 6*b*, the coupling shaft 164 can be dimensioned to fit within, and is positioned through, each first opening 134*b* of the webs 131*b*, 133*b* of the second yoke member 160. Additionally, the coupling shaft 164 can be dimensioned to engage each second opening 136*a* or open ended slots 134' of the webs 131*a*, 133*a* of the first yoke member 130. Likewise the connecting pin 170 can be dimensioned to fit within and to engage each second opening 136*b* or closed-ended slot 180 of the webs 131*b*, 133*b* of the second yoke member 160 and each first opening 134*a* of the webs 131*a*, 133*a* of the first yoke member 130.

Another embodiment provides a method of replacing a backboard assembly 14 using the quick change backboard bracket system 10 or 110. The method of replacing is better illustrated by the difference in positions of the yoke members between FIG. 4 and FIG. 5. The method can comprise the steps of providing a first backboard assembly 14, as described above, a second backboard assembly, not shown but substantially similar to the first backboard assembly 14, and a basketball goal support assembly 16, as described above. The connecting pin 70 can be disengaged from each opening 36*a*, 36*b* of the first backboard assembly 14 and each second aperture 68 of the basketball goal support assembly 16. If the connecting pin 70 includes a retainer pin 72, the retainer pin 72 is removed before the connecting pin 70 is removed from each opening 36*a*, 36*b* and each second aperture 68. The bracing member 52 of the basketball goal support assembly 16 can be decoupled from each bracket 23 of the first backboard assembly 14. Each slot 34*a*, 34*b* of the first backboard assembly 14 also can be disengaged from the coupling shaft 64 of the basketball goal support assembly 16.

The first backboard assembly 14 can then be removed and set aside and can be replaced with the second backboard assembly. Each slot 34*a*, 34*b* of the second backboard assembly can be engaged to the coupling shaft 64 of the basketball goal support assembly 16. The connecting pin 70 can be engaged to each opening 36*a*, 36*b* of the second backboard assembly and each second aperture 68 of the basketball goal support assembly 16. The bracing member 52 of the basketball goal support assembly 16 can be coupled to each bracket 23 of the second backboard. Preferably, these steps in combination with the quick change backboard bracket system can be completed quickly. For instance, the steps may be capable of completion during a timeout or halftime.

It is therefore intended that the foregoing detailed description be regarded as illustrative rather than limiting, and that it be understood that it is the following claims, including all equivalents, that are intended to define the spirit and scope of this invention.

What is claimed is:

1. A quick change backboard bracket system comprising:

a backboard assembly including a backboard having a peripheral frame including corner brackets, a first yoke member comprising a central plate coupled to the backboard, and a left web and a right web affixed to the central plate, the left and right webs oriented to extend rearwardly and perpendicular to the backboard and each web having a slot and an opening, and a rim assembly coupled to the central plate of the first yoke member through the backboard, wherein the rim assembly includes a mounting plate having apertures for receiving a fastener, and the central plate of the first yoke member includes apertures for receiving said fasteners passing through the mounting plate, backboard, and the central plate;

a basketball goal support assembly comprising a basketball goal support, a second yoke member including a middle plate coupled to the basketball goal support, a coupling shaft, a connecting pin, and a bracing member to couple the basketball goal support to the corner brackets of the backboard, the middle plate including a left arm and a right arm affixed to the middle plate, the left and right arms oriented to extend frontwardly and each arm having a first aperture and a second aperture, the coupling shaft extending laterally between the left and right arms and positioned through each first aperture, being configured to engage each slot of the first yoke member webs, and the connecting pin being removably attached through each opening of the first yoke member webs and each second aperture of the second yoke member arms, one of the arms of the second yoke member or the webs of the first yoke member separated by an outermost lateral distance that is less than an innermost lateral distance of the other of the arms of the second yoke member or the webs of the first yoke member;

means for fixedly attaching the coupling shaft to each first aperture; and means for engaging the connecting pin to each opening and each second aperture in order to couple the backboard assembly to the basketball goal assembly and wherein the peripheral frame of the backboard includes two corner brackets at an upper portion of the backboard and wherein a bracing member includes a free end extending from the basketball goal support, the free end of the bracing member being removably coupled to the two corner brackets of the upper portion of the backboard.

2. The quick change backboard bracket system of claim 1 wherein the bracing member is adapted to couple to at least one of the corner brackets of the backboard.

3. The quick change backboard bracket system of claim 1 wherein the bracing member comprises at least two supporting members oriented to extend vertically and frontwardly toward the backboard, each supporting member having a free end being configured to removably couple to the two corner brackets of the upper portion of the backboard with a pin and hairpin clip retainer.

4. The quick change backboard bracket system of claim 1 wherein the slot of said webs is multi-directional, with one direction being substantially parallel to the backboard.

5. The quick change backboard bracket system of claim 4 wherein the slot of the webs is located at an upper portion of the web.

6. The quick change backboard bracket system of claim 1 wherein the arms of the second yoke member are separated by an outermost lateral distance that is less than an innermost lateral distance of the webs of the first yoke member.

7. The quick change backboard bracket system of claim 6 wherein the coupling shaft has a lateral dimension greater than an outermost lateral distance of the webs of the first yoke member such that ends of the coupling shaft project beyond the second yoke member arms in order to engage each slot of the first yoke member webs.

8. The quick change backboard bracket system of claim 1 wherein the webs of the first yoke member are separated by an outermost lateral distance that is less than an innermost lateral distance of the arms of the second yoke member.

9. The quick change backboard bracket system of claim 1 wherein each first aperture of the second yoke member arms has an elliptical edge.

10. The quick change backboard bracket system of claim 1 wherein each slot of said webs is multi-directional, with one direction being substantially parallel to the backboard, and the elliptical edge of each first aperture has a first cross sectional distance in the horizontal direction greater than a second cross sectional distance in the vertical direction.

11. The quick change backboard bracket system of claim 1 wherein the slot of each web begins at a rear side of each web and extends diagonally to the portion of the slot that is substantially parallel to the backboard.

12. The quick change backboard bracket system of claim 11 wherein the slot ends toward an upper portion of the web.

13. The quick change backboard bracket system of claim 11 wherein the slot ends toward a lower portion of the web.

14. A quick change backboard bracket system comprising:

a backboard assembly including a backboard having a peripheral frame and including corner brackets, a first yoke member including a middle plate coupled to the backboard, the middle plate including apertures and a left arm and a right arm affixed to the middle plate, the left and right arms oriented to extend rearwardly, each arm having a first aperture and a second aperture, and a rim assembly having a mounting plate having apertures, wherein the rim assembly is coupled to the middle plate of the first yoke member through the backboard by fasteners extending through said apertures of the mounting plate of the rim assembly and the middle plate of the first yoke member;

a basketball goal support assembly comprising a basketball goal support, a bracing member to couple the basketball goal support to the corner brackets of the backboard, and a second yoke member including a central plate coupled to the basketball goal support, the central plate including a left web and a right web affixed to the central plate, the left and right webs oriented to extend frontwardly, each web having a slot and an opening;

a coupling shaft extending laterally between the left and right arms and positioned through each first aperture, the coupling shaft being configured to engage each slot of the second yoke member webs;

a connecting pin being removably attached through each opening of the second yoke member webs and each second aperture of the first yoke member arms, one of the arms of the first yoke member or the webs of the second yoke member separated by an outermost lateral distance that is less than an innermost lateral distance of the other of the arms of the first yoke member or the webs of the second yoke member;

means for fixedly attaching the coupling shaft to each first aperture; and means for engaging the connecting pin to each opening and each second aperture in order to couple the backboard assembly to the basketball goal assembly and wherein the peripheral frame of the backboard includes two corner brackets at an upper portion of the backboard and wherein the bracing member includes a free end extending from the basketball goal support, the free end of the bracing member being removably coupled to the two corner brackets of the upper portion of the backboard.

* * * * *